US006199452B1

(12) United States Patent
Vinar

(10) Patent No.: US 6,199,452 B1
(45) Date of Patent: Mar. 13, 2001

(54) PAIL OPENER AND RESEALER DEVICE

(76) Inventor: Dennis E. Vinar, 8787 Ridge Ponds La., Victoria, MN (US) 55386

( * ) Notice: Subject to any disclaimer, the term of this patent is extended or adjusted under 35 U.S.C. 154(b) by 0 days.

(21) Appl. No.: 09/396,259

(22) Filed: Sep. 15, 1999

Related U.S. Application Data

(60) Provisional application No. 60/100,526, filed on Sep. 16, 1998.

(51) Int. Cl.[7] ..... B67B 7/16
(52) U.S. Cl. ..... 81/3.57; 81/3.36
(58) Field of Search ..... 81/3.55, 3.56, 81/3.57, 3.07, 3.09, 3.36, 3.47; 7/151

(56) References Cited

U.S. PATENT DOCUMENTS

| | | | | |
|---|---|---|---|---|
| D. 192,721 | | 5/1962 | Mills . | |
| D. 240,497 | | 7/1976 | Riba . | |
| D. 244,575 | | 6/1977 | Endres et al. . | |
| D. 252,907 | | 9/1979 | Poll . | |
| D. 271,275 | | 11/1983 | Richilano . | |
| D. 276,304 | | 11/1984 | DiFede . | |
| D. 276,585 | | 12/1984 | DiFede . | |
| D. 304,992 | | 12/1989 | Matthies . | |
| D. 319,954 | | 9/1991 | Able et al. . | |
| D. 359,220 | | 6/1995 | Vinar . | |
| 3,954,030 | * | 5/1976 | Newton | 81/3.46 R |
| 4,492,132 | | 1/1985 | Obey . | |
| 4,586,404 | | 5/1986 | Ginther . | |
| 4,747,173 | | 5/1988 | Marceau . | |
| 4,829,619 | | 5/1989 | Edgerton . | |
| 4,967,436 | * | 11/1990 | Russell | 7/156 |
| 5,069,090 | | 12/1991 | Clark . | |
| 5,222,265 | * | 6/1993 | Hermansson | 7/156 |
| 5,476,023 | * | 12/1995 | Calandro | 81/3.57 |

OTHER PUBLICATIONS

Silesia Quick and Easy 3 in 1 bucket opener, product brochure, 1 page.

* cited by examiner

*Primary Examiner*—Timothy V. Eley
*Assistant Examiner*—Dung Van Nguyen
(74) *Attorney, Agent, or Firm*—Anthony G. Eggink

(57) ABSTRACT

A tool device constructed and arranged to open and reseal plastic pail lids. The device is comprised of a rigid, unitary, and elongated body structure with a center and a tip end. The body structure having a handle portion, a lid opening structure, and a lid closing structure. The body structure has a lower portion and an upper portion, a top side, and a bottom side. The lower portion of the body structure being comprised of the handle portion and the upper portion being comprised of the lid opening structure and the lid closing structure. The lid opening structure is comprised of a first hook and a second hook extending from the bottom edge of the upper portion of the device. The first hook extends from the bottom edge of the end of the upper portion with the hook curving back toward the center of the body structure. The second hook extends generally from the center of the bottom edge of the body structure and curves toward the tip end having the first hook. The lid closing structure is comprised of a hammer portion extending from the top edge of the upper portion of the body structure of the device.

18 Claims, 1 Drawing Sheet

PAIL OPENER AND RESEALER DEVICE

This application claims the benefit of U.S. Provisional Application No. 60/100,526 filed on Sep. 16, 1998.

BACKGROUND OF THE INVENTION

The present invention relates generally to a pail opener and resealer device. Particularly, this invention relates to a light weight tool device for opening and resealing from pails containing various products such as foods, paints, oils, and the like. More particularly, the device of this invention is used to remove and reseal plastic lids from plastic pails and suited for use by homeowners, restaurants, supermarkets, printers, schools, and by contractors for use with driveway, painting, drywall materials, and the like.

Often users may try to remove large pail lids by hand, with a cutting device, or with other tools that are not suited for pail opening. When removed by hand or using unsuited tools, the pail lid or the tool may injure a person's hand or other part of the body, due to the rigid and/or sharp pail or lid material. A user may also utilize a cutting device to remove the lid, however, this process may destroy the lid making it impossible to properly reseal the remaining product inside of the pail. Furthermore, the cutting device itself could injure the user during use.

The device of this invention overcomes the shortcomings of other lid removal tools and methods by allowing the easy removal of a pliable plastic lid from a pail while preventing injury to the user and destruction of the lid. The device further allows the lid to be easily resealed to the pail, thus resealing and protecting the remaining contents inside the pail. The device of this invention is rigid, light-weight and unitary in structure, and is comprised of an elongated body structure having a handle portion, a lid opening structure, and a lid closing structure.

SUMMARY OF THE INVENTION

The present device comprises a light-weight tool that is constructed and arranged to open and reseal pail lids. The device is preferably used to open and reseal 2–5 gallon plastic pails, however, the device may also be used with pails constructed in other sizes and constructed of other materials. The tool device of this invention may be used for purposes such as opening and resealing plastic pails containing foods, paints, oils, and other contents.

The pail opener and resealer device of this invention is generally comprised of a unitary, rigid body structure having a handle member, a lid opening structure and a lid closing structure.

The device of this invention is constructed and arranged to remove a pliable plastic lid from a plastic pail by using the lid opening structure. The lid opening structure is comprised of a hook and fulcrum structure. The body structure is constructed of an elongated body having a center, a tip end, and preferably has two hooks, the first hook being utilized to pry the rim of the lid while the second hook acts as a fulcrum, thereby allowing the handle to be utilized as a lever to provide the force necessary to pry the lid. The device preferably has an upper hook that extends from the tip end of the body structure with the hook curving back toward the center of the body structure and a lower hook that extends generally from the center of the body structure and curves upward toward the tip end of the body structure, thereby arranged so that the hooks face each other. The device can be utilized to remove a lid in two ways, in one method the upper hook is used as the prying hook and in the other method, the lower hook is used as the prying hook.

The first method used to remove a lid illustrates that a user may grasp the handle portion and place the upper hook under the bottom of the rim of the lid, utilizing it as a prying hook. The lower hook is then rested on the top of the lid, thereby using the lower hook as a fulcrum and enabling the handle to be used as a lever. Next, the user pushes downward on the handle portion which prys the lid, separating it from the pail or bucket.

Alternatively, a lid may be removed by placing the lower hook under the rim of the lid, utilizing it as a prying hook, and having the upper hook resting on the top of the lid, thereby using the upper hook as a fulcrum. The handle is then pulled upward to separate the lid from the bucket. These process steps may be repeated at different points around the circumference of the lid which results in the total separation of the lid from the rim of the pail.

The device is also constructed and arranged to reseal a lid to a pail by using the lid closing structure. The lid closing structure is comprised of a hammer portion extending from the top side of the tip end of the body structure. To reseal the lid, a user places the lid on top of the open pail. The user then grasps the handle portion of the tool with the hammer portion facing downward towards the top of the lid and strikes or pounds the lid onto the rim of the pail with the hammer portion, so that the lid rim is resealed to the pail rim.

The pail opener and resealer device is preferably constructed of a light-weight, rigid and strong material. For example, cast aluminum, other metallic alloys and molded plastic compositions, with or without reinforcing materials, may be utilized in forming the body structure of the device.

These and other benefits of this invention will become clear from the following description by reference to the drawings.

DESCRIPTION OF THE PREFERRED EMBODIMENTS

The present device comprises a light-weight tool that is constructed and arranged to open and reseal pail lids. The device of this invention may be used for purposes such as opening and resealing lids from pails containing various food products, paints, oils, or other contents. The device allows easy removal, particularly of a plastic lid, from a plastic pail while preventing injury to the user and destruction of the lid structure. The device further allows the lid to be easily resealed to the pail, thus protecting the remaining products inside of the pail.

Figure 1:
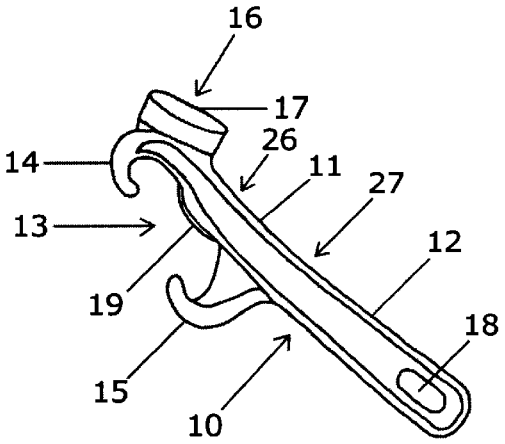
FIG. 1 is a perspective view of the pail opener and resealer device.
Figure 2:
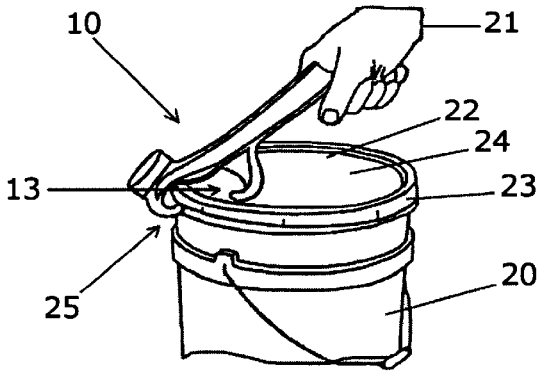
FIG. 2 is a perspective view and showing the pail opener and resealer device in a lid removing position.
Figure 3:
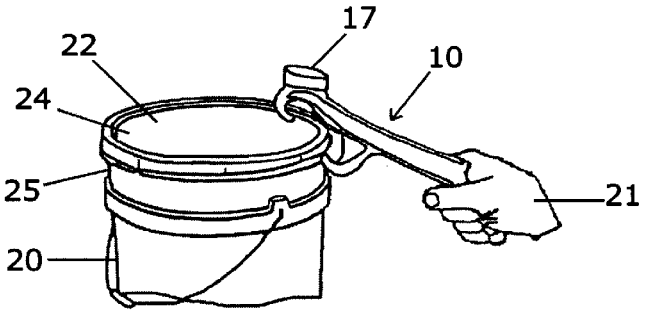
FIG. 3 is a perspective view showing the pail opener and resealer device in an alternative lid removing position.
Figure 4:
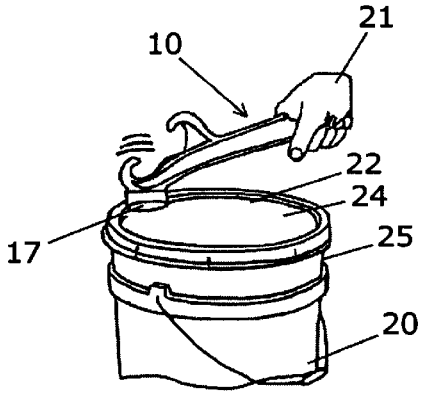
FIG. 4 is a perspective view showing the pail opener and re-sealer device in the resealing position.

Referring to FIG. 1, the pail opener and resealer device 10 of this invention is shown. The pail opener and resealer device 10 of the present invention is comprised of a unitary, rigid body structure 11 having a handle portion 12, a lid opening structure 13, and a lid closing structure 16. Lid opening structure 13 is shown comprised of an upper hook 14 and a lower hook 15 which are constructed and arranged to engage lid 22 of pail 20, as shown in FIGS. 2 and 3. Lid closing structure 16 extends from the top side of the tip end of body structure 11 and is comprised of a hammer portion 17 having a flat striking surface for resealing lid 22 back onto pail 20, as shown in FIG. 4. Body structure 11 further is shown to have an aperture 18 in handle portion 12 to provide means for hanging the device for storage purposes. For example, the aperture 18 in handle portion 12 allows device 10 to be hung on a nail or the like for easy and convenient storage. The device is preferably light-weight and rigid and may be constructed from materials such as plastic, cast aluminum, other light-weight materials, or the like. For example, the device may be injection molded of a plastic composition comprised of a polymer or copolymer and may utilize a glass filled nylon for increased toughness and strength.

The tool device 10 is shown to have a generally curved body structure 11 having an indented centrally disposed wall and peripheral borders or edges. The flattened areas 19 which extend outward from the peripheral borders between the upper hook 14 and lower hook 15 are provided to balance the tool body 11 during use as shown in FIGS. 2 and 3. The curved body structure 11 further provides a widened and heightened handle portion 12 for increased gripping control by the user's hand 21.

Referring to FIG. 2, the pail opener and resealer device 10 is shown in one of two lid removal positions. To remove lid 22, a user's hand 21 may grasp the handle portion 12 and place upper hook 14 under the bottom of rim 23 of lid 22 and rest lower hook 15, acting as a fulcrum, on top 24 of lid 22. A flattened and flared portion 19 located on the bottom edge of upper portion 26 provides an expanded surface to aid in maintaining the stability of device 10 during removal of lid 22. The user's hand 21 then pushes downward on handle portion 12 which separates the rim or peripheral edge 23 of lid 22 from pail rim 25 of pail 20. Alternatively, as shown in FIG. 3, lower hook 15 may be placed under rim 23 of lid 22 and upper hook 14 may be used as a fulcrum by placing it on top 24 of lid 22. In this configuration, handle portion 12 is lifted, thereby separating rim 23 of lid 22 from pail 20. These processes may be repeated at different points around the circumference of the pail lid until lid 22 is totally separated from pail 20.

Upper hook 14 and lower hook 15 are spaced at a predetermined distance from one another to remove standard-sized plastic pail lids, however, the hook portions may be spaced at different lengths to accommodate the removal of varying lid sizes. For example, this tool structure of the present invention has been found to function well in the opening and resealing of 2–5 gallon plastic pails.

Referring to FIG. 4, the pail opener and resealer device 10 is shown in the lid resealing position. To reseal lid 22, the lid 22 is first placed on top of open pail 20. The user's hand 21 then grasps handle portion 12 of the pail opener and resealer device 10 with hammer portion 17 facing downward toward top 24 of lid 22. The user's hand 21 strikes or pounds lid 22 about rim 25 of pail 20 with hammer portion 17 and progresses around the circumference of lid 22 until the bottom of lid rim 23 is resealed about the top of pail rim 25.

In FIGS. 1–4 pail opener and resealer device 10 is shown as having a distinct configuration, however, the device may be constructed in different shapes and sizes. For example, the lid opening structure and lid closing structure may be positioned on opposite ends of the body structure. It has been found preferable that a tool device of this invention be unitary in structure and light-weight. For example, cast aluminum, light-weight metallic alloys and plastic tool structures have been found suitable. Furthermore, a tool length of approximately 8½ inches, as measured from the front of the hammer portion to the back of the handle portion, has been found to give proper resealing force as well as leverage in opening the lid when the first hook and second hook are spaced approximately 2¾ inches (inside spacing) and 7¾ inches from hook tip to hook tip. And, although a hook structure is preferred for use as the fulcrum, other shapes that can be utilized as a fulcrum may be used. Additionally, a flattened portion of approximately 1 inch wide and 1 ½ inches long positioned between the upper hook and the lower hook of the lid opening structure aids in positioning the tool when opening a pail. The flattened portion is preferably configured in an oval shape, however, the portion may be constructed in a variety of shapes. The hammer portion of the lid closing structure is preferably a cylindrical structure having a flat striking face of approximately 1½ inches in diameter and approximately ½ inch in thickness. These tool dimensions and compositions are exemplary and modifications and changes may be made by those skilled in the art.

As many changes are possible to the embodiments of this invention utilizing the techniques thereof, the descriptions above, and the accompanying drawings should be interpreted in the illustrative and not in the limited sense.

That which is claimed is:

1. A pail opener and resealer device having a unitary, rigid and lightweight body structure with a center and a tip end, said device comprising:

a) a handle portion;

b) a lid opening structure comprising a fulcrum structure, a prying hook, and a flattened portion disposed between said fulcrum structure and said prying hook, said flattened portion having a positioning surface thereon; and c) a lid closing structure comprising a hammer portion.

2. The device of claim 1 wherein said fulcrum structure is a second hook, said prying and second hooks being constructed and arranged to face each other.

3. The device of claim 1 wherein said fulcrum structure is disposed at generally said center of said body structure and said prying hook is disposed at said tip end of said body structure.

4. The device of claim 3 wherein said fulcrum is a second hook.

5. The device of claim 1 wherein said fulcrum structure is disposed at generally said tip end of said body structure and said prying hook is disposed at generally said center of said body structure.

6. The device of claim 5 wherein said fulcrum is a second hook.

7. The device of claim 1 wherein said body structure has a lower portion and an upper portion, said upper portion including said tip end of said body structure and further having a top side and a bottom side and wherein said lower portion is comprised of said handle portion and wherein said upper portion is comprised of said lid opening structure and said lid closing structure.

8. The device of claim 7 wherein said lid opening structure extends from said bottom side of said upper portion and said lid closing structure extends from said top side of said upper portion.

9. The device of claim 7 wherein said fulcrum structure and said prying hook are comprised of an upper hook extending from said bottom side of said tip end of said upper portion and a lower hook extending from said bottom side of said upper portion.

10. The device of claim 7 wherein said lid closing structure extends from said top side of said tip end of said upper portion.

11. The device of claim 1 wherein said handle portion contains an aperture therethrough.

12. The device of claim 1 wherein said device is constructed from cast aluminum.

13. The device of claim 1 wherein said device is constructed from plastic.

14. The device of claim 1 wherein said device is unitarily constructed.

15. The device of claim 1 wherein said flattened portion has an oval configuration and a flat positioning surface.

16. A pail opener and resealer device having a lightweight and rigid body structure comprising:

a) a lower portion, said lower portion comprising a handle portion; and b) an upper portion, said upper portion having a lid opening structures, a flattened portion, and a lid closing structure, said lid opening structure comprising two hooks constructed and arranged to face each other, said flattened portion disposed between said two hooks and having a positioning surface thereon, and said lid closing structure comprising a hammer portion having a striking surface.

17. The device of claim 16 wherein said hammer portion has a round cylindrical configuration having a flat striking surface.

18. The device of claim 16 wherein said device is approximately 8.50 inches in length, said hooks are spaced approximately 2.75 inches apart, and said hammer portion striking surface is approximately 1.50 inches in diameter and 0.50 inches in thickness.

* * * * *